US008890914B1

(12) United States Patent
Chang

(10) Patent No.: US 8,890,914 B1
(45) Date of Patent: Nov. 18, 2014

(54) THERMAL PRINTER WITH EASY ASSEBLY

(71) Applicants: IEI Integration Corp., New Taipei (TW); Armorlink SH Corp., Shang-Hai (CN)

(72) Inventor: Yu-Tsung Chang, New Taipei (TW)

(73) Assignees: IEI Integration Corp., Xizhi Dist., New Taipei (TW); Armorlink SH Corp., Min-Sing-Sin-Jhuang Industrial District, Shang-Hai (CN)

( * ) Notice: Subject to any disclaimer, the term of this patent is extended or adjusted under 35 U.S.C. 154(b) by 0 days.

(21) Appl. No.: 14/141,454

(22) Filed: Dec. 27, 2013

(30) Foreign Application Priority Data

Nov. 5, 2013 (CN) ..... 2013 1 0543141

(51) Int. Cl.

| | |
|---|---|
| ***B41J 2/32*** | (2006.01) |
| ***B41J 2/325*** | (2006.01) |
| ***B41J 3/00*** | (2006.01) |
| ***B41J 2/335*** | (2006.01) |

(52) U.S. Cl.
CPC ..... *B41J 2/335* (2013.01)
USPC ..... 347/197; 347/198; 347/171; 347/222; 347/2

(58) Field of Classification Search
USPC ..... 347/197, 198, 222, 2, 171
See application file for complete search history.

(56) References Cited

U.S. PATENT DOCUMENTS

| | | | | |
|---|---|---|---|---|
| 5,366,302 | A * | 11/1994 | Masumura et al. | 400/120.16 |
| 7,391,428 | B2 * | 6/2008 | Lee | 347/197 |
| 2013/0161369 | A1 * | 6/2013 | Chen | 226/49 |

* cited by examiner

*Primary Examiner* — Sarah Al Hashimi
(74) *Attorney, Agent, or Firm* — Winston Hsu; Scott Margo

(57) ABSTRACT

A thermal printer includes a casing, a thermal head module and a guiding component. The thermal head module is detachably installed inside the casing, and the thermal head module includes a bracket, a thermal head and a pivoting component. The thermal head is installed on the bracket, and the pivoting component is disposed on an end of the bracket. The pivoting component is pivotally engaged with the casing. The guiding component is rotatably installed inside the casing and for guiding a printing medium. The guiding component includes a holding portion for holding the pivoting component of the thermal head module as the guiding component rotates in a first rotating direction relative to the casing, so as to drive the pivoting component to separate from the casing, so that the thermal head module is detached from the casing.

11 Claims, 5 Drawing Sheets

THERMAL PRINTER WITH EASY ASSEBLY

BACKGROUND OF THE INVENTION

1. Field of the Invention

The present invention relates to a thermal printer, and more specifically, to a thermal printer having a thermal print head with easy assembly.

2. Description of the Prior Art

A conventional thermal printer includes a thermal print module for performing thermal print, and a thermal print head is disposed on the thermal print module. The conventional thermal print module is often fixed inside a casing of the thermal printer by fastening components, such as screws, so as to increase stability and to decrease errors in a procedure of thermal print. However, the thermal print head is easily damaged after being used for a long time, so that it has to detach the thermal print module from the thermal printer to repair. As the thermal print module is screwed inside the casing of the thermal printer, the thermal print module just can be taken out to be repaired after all of screws are removed, resulting in inconvenience of repair and wasting time of replacement. Therefore, it is an important issue to design a thermal printer with easy assembly.

SUMMARY OF THE INVENTION

The present invention is to provide a thermal printer with easy assembly to solve above problems.

According to the disclosure, the thermal printer includes a casing, a thermal head module and a guiding component. An engaging slot is formed on the casing. The thermal head module is detachably installed inside the casing, and the thermal head module includes a bracket, a thermal head and a pivoting component. The thermal head is installed on the bracket. The pivoting component is disposed on an end of the bracket and is pivotally engaged with the engaging slot of the casing. The guiding component is rotatably installed inside the casing and for guiding a printing medium. The guiding component includes a holding portion for holding the pivoting component of the thermal head module as the guiding component rotates in a first rotating direction relative to the casing, so as to drive the pivoting component to separate from the engaging slot, so that the thermal head module is detached from the casing.

According to the disclosure, the thermal head module further includes a plate component and a resilient component. An end of the plate component sheathes the pivoting component, so that the bracket pivots relative to the plate component. An end of the resilient component is connected to the other end of the plate component, and the other end of the resilient component is connected to the bracket. The resilient component is for providing the bracket with a resilient force, so that the bracket pivots relative to the plate component to drive the thermal head to press the printing medium.

According to the disclosure, an installing slot is disposed on the bracket, the end of the resilient component is fixed to the plate component, and the other end of the resilient component is installed inside the installing slot.

According to the disclosure, the plate component comprises a first surface and a second surface, the first surface and the second surface contact against a first contacting surface and a second contacting surface as the pivoting component is engaged with the engaging slot of the casing, so that the thermal head module is fixed in a fixing position as being installed inside the casing.

According to the disclosure, the resilient component is a spring.

According to the disclosure, the guiding component further comprises a contacting portion for contacting against the bracket as the thermal head module is installed inside the casing.

According to the disclosure, the thermal printer further includes a contacting component and a resilient component. An end of the contacting component is pivoted to the casing, and a contacting portion is disposed on the other end of the contacting component and for contacting against a side of the bracket. An end of the resilient component is connected to the casing, and the other end of the resilient component is connected to the contacting component. The resilient component is for providing the contacting component with a resilient force to pivot the pivoting component to press the thermal head module by the contacting portion, so that the thermal head presses the printing medium.

According to the disclosure, a slot is disposed on the contacting component, the end of the resilient component is fixed to the casing, and the other end of the resilient component is installed inside the slot.

According to the disclosure, the pivoting component is a shaft, and the holding portion comprises a groove slot for engaging with the shaft.

According to the disclosure, the holding portion holds the pivoting component of the thermal head module and the guiding component pivots in a second rotating direction opposite to the first rotating direction relative to the casing, so that the thermal head module is installed inside the casing and the pivoting component is engaged with the engaging slot, and then the holding portion of the guiding component is separated from the pivoting component.

The thermal printer includes the detachable thermal print module and the guiding component. As the thermal print head of the thermal print module needs to be repaired or be replaced, it only needs to rotate the guiding component in the first rotating direction, and the holding portion holds the pivoting component of the thermal print module, so as to separate the thermal print module from the casing. As it is desired to install the thermal print module inside the casing, the thermal print module can be installed on the guiding component first, and then the guiding component is rotated in the second rotating direction into the casing, so as to install the thermal print module inside the engaging slot of the casing quickly. The first contacting surface and the second contacting surface are disposed on the casing for contacting against the first surface and the second surface respectively as the thermal print module is installed inside the casing, so that the thermal head module can be installed in the fixing position of the casing accurately, so as to achieve the best print result. Therefore, it solves the conventional problem that the conventional thermal print module can only be taken out after all of screws, which fasten the conventional thermal print module on the casing, are removed, resulting in inconvenience of repair and wasting time of replacement.

These and other objectives of the present invention will no doubt become obvious to those of ordinary skill in the art after reading the following detailed description of the preferred embodiment that is illustrated in the various figures and drawings.

DETAILED DESCRIPTION

Figure 1:
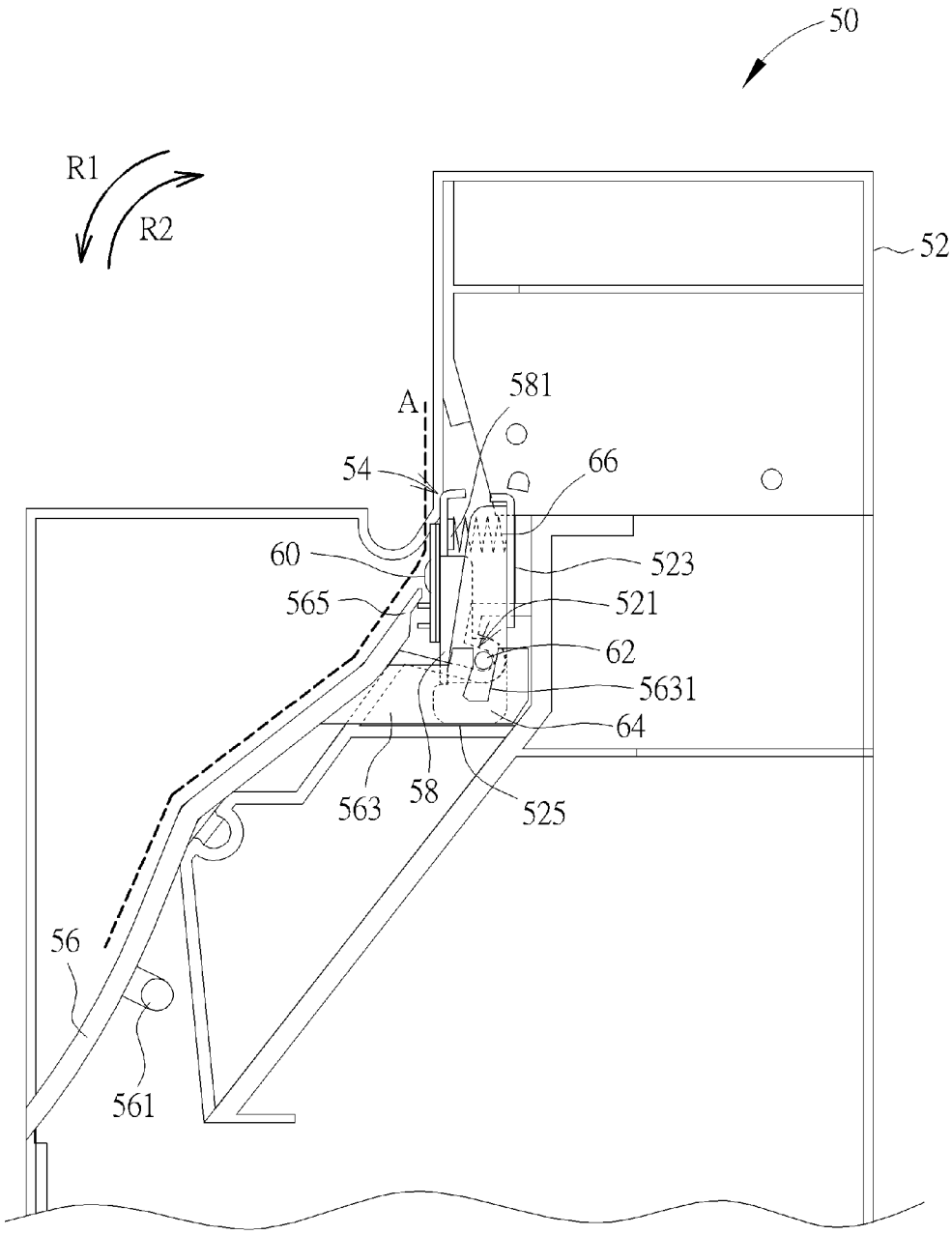
FIG. 1 and FIG. 2 are internal structural diagrams of a thermal printer indifferent states according to an embodiment of the present invention.
Figure 2:
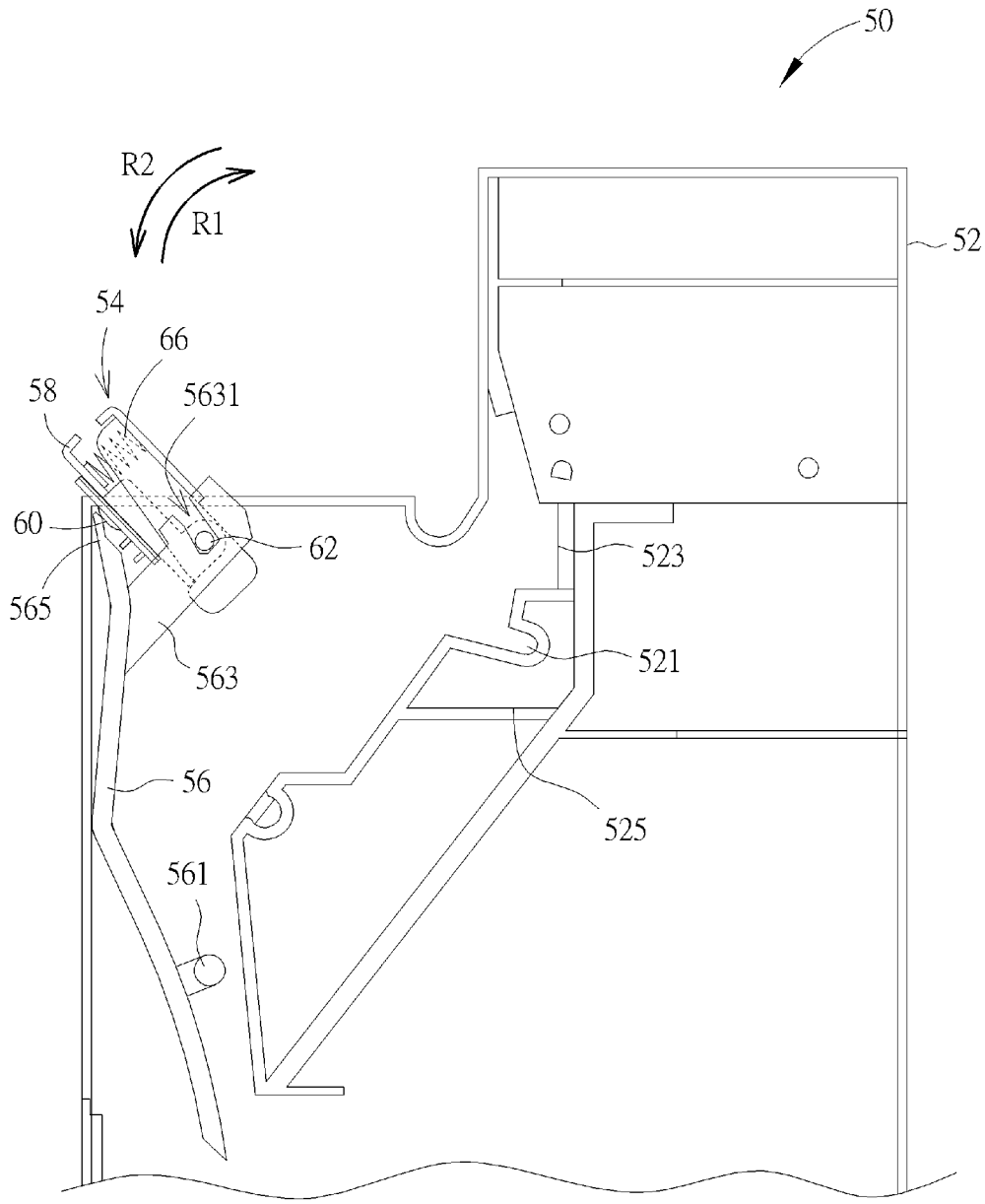
Figure 3:
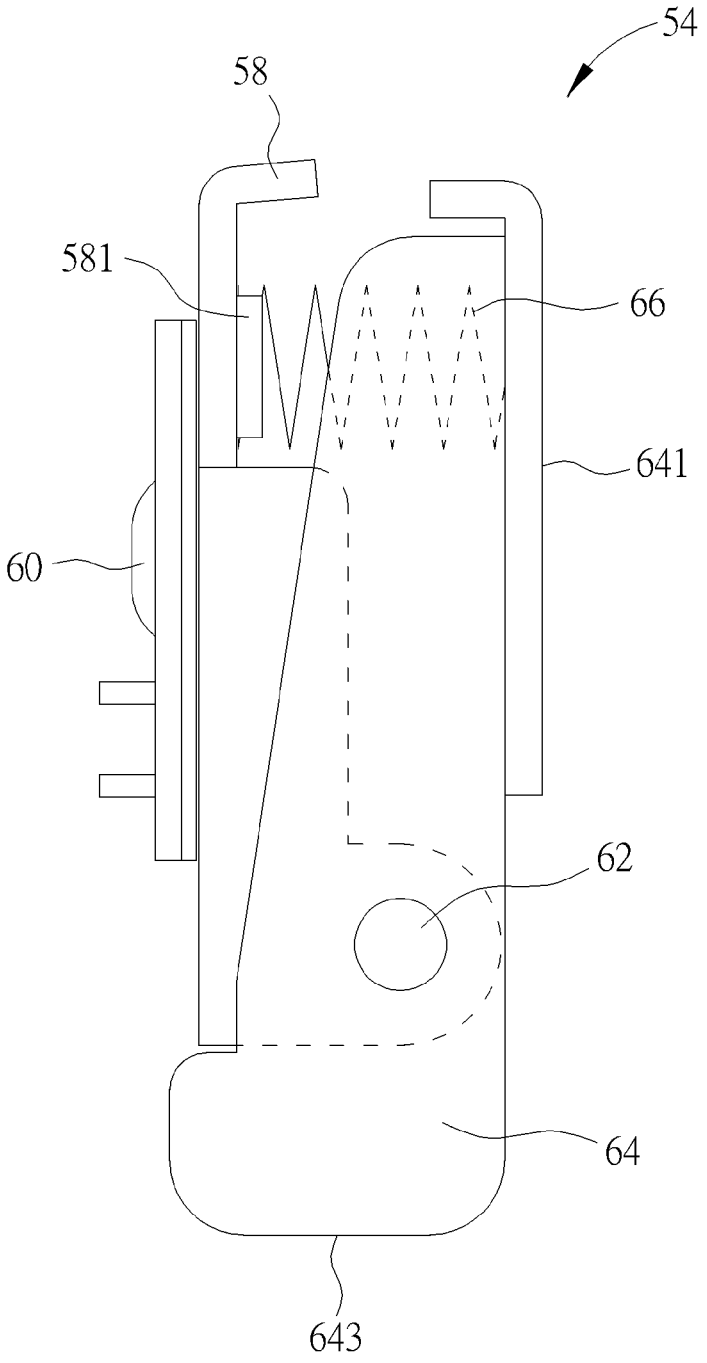
FIG. 3 is a diagram of a thermal print module according to the embodiment of the present invention.

Please refer to FIG. 1 to FIG. 2. FIG. 1 and FIG. 2 are internal structural diagrams of a thermal printer 50 in different states according to an embodiment of the present invention. The thermal printer 50 includes a casing 52, a thermal print module 54 and a guiding component 56. An engaging slot 521 is formed on the casing 52, and the thermal print module 54 is detachably installed inside the engaging slot 521 of the casing 52. Please refer to FIG. 1 to FIG. 3. FIG. 3 is a diagram of the thermal print module 54 according to the embodiment of the present invention. The thermal print module 54 of the present invention includes a bracket 58, a thermal print head 60, a pivoting component 62, a plate component 64 and a resilient component 66. The thermal print head 60 is installed on the bracket 58. The pivoting component 62 is disposed on an end of the bracket 58 and protrudes outside the end of the bracket 58, and the pivoting component 62 is pivotally engaged with the engaging slot 521 of the casing 52. The pivoting component 62 can be a long shaft passing through the end of the bracket 58, so as to protrude outside two sides of the end of the bracket 58 and to be fixed on the bracket 58. The pivoting component 62 can also be two short shafts fixed on the two sides of the end of the bracket 58, but is not limited to it. An end of the plate component 64 sheathes the pivoting component 62. That is, the pivoting component 62 also protrudes outside two sides of the end of the plate component 64, so that the bracket 58 can pivot relative to the plate component 64. An end of the resilient component 66 is connected to the other end of the plate component 64, and the other end of the resilient component 66 is connected to the bracket 58. An installing slot 581 is disposed on the bracket 58, the end of the resilient component 66 is fixed to the plate component 64, and the other end of the resilient component 66 is installed inside the installing slot 581. In this embodiment, the resilient component 66 can be a spring.

The guiding component 56 is rotatably installed inside the casing 52 via a shaft 561. That is, the guiding component 56 can rotate in a first rotating direction R1 or in a second rotating direction R2 opposite to the first rotating direction R1 around the shaft 561. The guiding component 56 is for guiding a printing medium A. The printing medium A can be a thermal print paper and moves toward the thermal print head 60 along the guiding component 56 when the thermal print is performed. The guiding component 56 includes a holding portion 563, and the holding portion 563 can include a groove slot 5631. As shown in FIG. 1, when the thermal print module 54 is installed inside the engaging slot 521 of the casing 52, the holding portion 563 of the guiding component 56 can be for holding the pivoting component 62 of the thermal head module 54 as the guiding component 56 rotates in the first rotating direction R1 relative to the casing 52 around the shaft 561, so as to drive the pivoting component 62 to separate from the engaging slot 521, so that the thermal head module 54 is detached from the casing 52, as shown in FIG. 2. Therefore, the thermal print module 54 can be taken out of the casing 52 easily to perform following repair procedures.

As it is desired to install the thermal print module 54 inside the casing 52, for example, after the thermal print head 60 of the thermal print module 54 has already been repaired, the thermal print module 54 can be installed on the holding portion 563 of the guiding component 56 first, as shown in FIG. 2. At this time, the pivoting component 62 of the thermal print module 54 is engaged with the groove slot 5631. That is, the holding portion 563 holds the pivoting component 62 of the thermal print module 54. Then, the guiding component 56 is rotated in the second rotating direction R2 opposite to the first rotating direction R1 relative to the casing 52, so as to engage the pivoting component 62 with the engaging slot 521 and install the thermal print module 54 inside the casing 52. It is noticed that the holding portion 563 of the guiding component 56 is separated from the pivoting component 62 after the pivoting component 62 is engaged with the engaging slot 521. That is, the groove slot 5631 does not interfere with the pivoting component 62, so as to ensure that the thermal print module 54 is stably fixed inside the casing 52.

In addition, please refer to FIG. 1 to FIG. 3, the plate component 64 includes a first surface 641 and a second surface 643. As the pivoting component 62 is engaged with the engaging slot 521 of the casing 52, the first surface 641 and the second surface 643 contact against a first contacting surface 523 and a second contacting surface 525 of the casing 52 respectively, so that the thermal head module 54 can contact against internal structural components of the casing 52 and be fixed in a fixing position accurately as being installed inside the casing 52, as shown in FIG. 1. Furthermore, the guiding component 56 can further include a contacting portion 565 for contacting against the bracket 58 as the thermal head module 54 is installed inside the casing 52, as shown in FIG. 1, so that the thermal print module 54 can be fixed in the fixing position stably. Therefore, as the printing medium A moves along the guiding component 56, a roller of the thermal printer 50, not shown in figures, can press the printing medium A on the thermal print head 60 correctly, so as to achieve the best print result. For example, the printing medium A is between the roller and the thermal print head 60, and the roller and the thermal print head 60 are in tangential contact with each other. As the roller presses the printing medium A on the thermal print head 60, the resilient component 66 is for providing the bracket 58 with a resilient force, so that the bracket 58 pivots relative to the plate component 64 to drive the thermal head 60 to press on the printing medium A.

Figure 4:
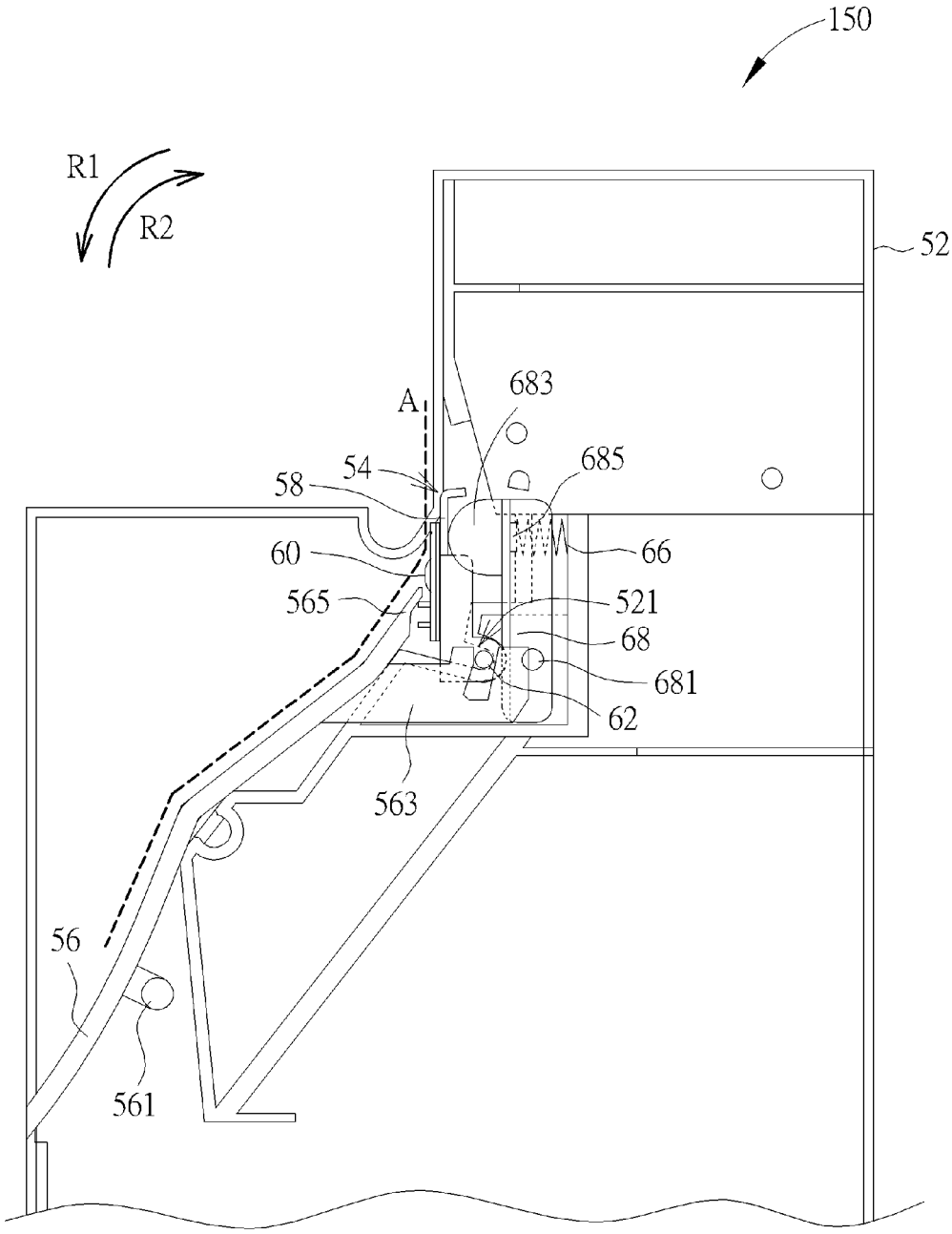
FIG. 4 and FIG. 5 are internal structural diagrams of a thermal printer in different states according to another embodiment of the present invention.
Figure 5:
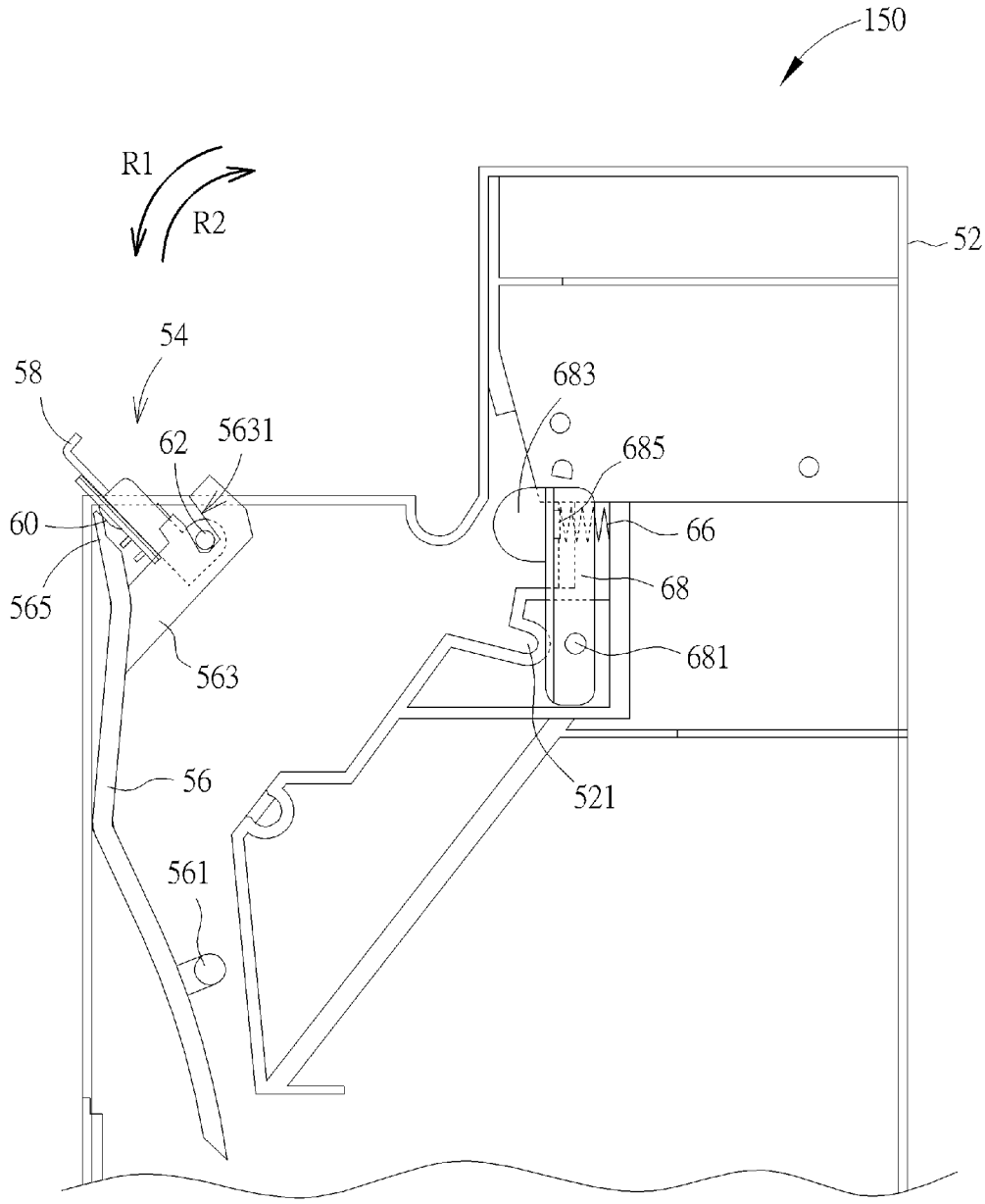

Please refer to FIG. 3 to FIG. 5. FIG. 4 and FIG. 5 are internal structural diagrams of a thermal printer 150 in different states according to another embodiment of the present invention. In this embodiment, the thermal printer 150 also includes the casing 52, the thermal print module 54 and the guiding component 56, and the thermal print module 54 includes the bracket 58, the thermal print head 60, the pivoting component 62, the resilient component 66 and a contacting component 68. An end of the contacting component 68 is pivoted to the casing 52 by a pivoting shaft 681, and a contacting portion 683 is disposed on the other end of the contacting component 68 and for contacting against a side of the bracket 58, as shown in FIG. 4. A slot 685 is disposed on the contacting component 68, the end of the resilient component 66 is fixed to the casing 52, and the other end of the resilient component 66 is installed inside the slot 685. As the thermal print module 54 is installed in the engaging slot 521, the resilient component 66 is for providing the contacting component 68 with the resilient force, so that the contacting component 68 pivots around the pivoting shaft 681 and the contacting portion 683 pushes the bracket 58, so as to press the thermal print head 60 on the printing medium A, and then a pattern or text can be printed on the printing medium A by thermal print. As the thermal print module 54 needs to be repaired, the guiding component 56 also can be rotated in the first rotating direction R1 relative to the casing 52 around the shaft 561, and the groove slot 5631 of the holding portion 563 holds the pivoting component 62 of the thermal print module 54, so as to drive the pivoting component 62 to separate from the engaging slot 521, so that the thermal head module 54 is detached from the casing 52. As shown in FIG. 5, a difference between this embodiment and the previous embodiment is that the contacting component 68 for pushing the bracket 58 and the resilient component 66 are disposed on the casing 52, instead of being connected to the pivoting component 62 and the bracket 58, so as to meet different design demands.

In contrast to prior art, the thermal printer includes the detachable thermal print module and the guiding component. As the thermal print head of the thermal print module needs to be repaired or be replaced, it only needs to rotate the guiding component in the first rotating direction, and the holding portion holds the pivoting component of the thermal print module, so as to separate the thermal print module from the casing. As it is desired to install the thermal print module inside the casing, the thermal print module can be installed on the guiding component first, and then the guiding component is rotated in the second rotating direction into the casing, so as to install the thermal print module inside the engaging slot of the casing quickly. The first contacting surface and the second contacting surface are disposed on the casing for contacting against the first surface and the second surface respectively as the thermal print module is installed inside the casing, so that the thermal head module can be installed in the fixing position of the casing accurately, so as to achieve the best print result. Therefore, it solves the conventional problem that the conventional thermal print module can only be taken out after all of screws, which fasten the conventional thermal print module on the casing, are removed, resulting in inconvenience of repair and wasting time of replacement.

Those skilled in the art will readily observe that numerous modifications and alterations of the device and method may be made while retaining the teachings of the invention. Accordingly, the above disclosure should be construed as limited only by the metes and bounds of the appended claims.

What is claimed is:

1. A thermal printer, comprising:

a casing whereon an engaging slot is formed;

a thermal head module detachably installed inside the casing, the thermal head module comprising:

a bracket;

a thermal head installed on the bracket; and a pivoting component disposed on an end of the bracket and pivotally engaged with the engaging slot of the casing; and a guiding component rotatably installed inside the casing and for guiding a printing medium, the guiding component comprising a holding portion for holding the pivoting component of the thermal head module as the guiding component rotates in a first rotating direction relative to the casing, so as to drive the pivoting component to separate from the engaging slot, so that the thermal head module is detached from the casing.

2. The thermal printer of claim 1, wherein the thermal head module further comprises:

a plate component, an end of the plate component sheathing the pivoting component, so that the bracket pivots relative to the plate component; and a resilient component, an end of the resilient component being connected to the other end of the plate component, the other end of the resilient component being connected to the bracket, and the resilient component being for providing the bracket with a resilient force, so that the bracket pivots relative to the plate component to drive the thermal head to press the printing medium.

3. The thermal printer of claim 2, wherein an installing slot is disposed on the bracket, the end of the resilient component is fixed to the plate component, and the other end of the resilient component is installed inside the installing slot.

4. The thermal printer of claim 2, wherein the plate component comprises a first surface and a second surface, the first surface and the second surface contact against a first contacting surface and a second contacting surface as the pivoting component is engaged with the engaging slot of the casing, so that the thermal head module is fixed in a fixing position as being installed inside the casing.

5. The thermal printer of claim 2, wherein the resilient component is a spring.

6. The thermal printer of claim 1, wherein the guiding component further comprises a contacting portion for contacting against the bracket as the thermal head module is installed inside the casing.

7. The thermal printer of claim 1, further comprising:

a contacting component, an end of the contacting component being pivoted to the casing, a contacting portion being disposed on the other end of the contacting component and for contacting against a side of the bracket; and a resilient component, an end of the resilient component being connected to the casing, the other end of the resilient component being connected to the contacting component, the resilient component being for providing the contacting component with a resilient force to pivot the pivoting component to press the thermal head module by the contacting portion, so that the thermal head presses the printing medium.

8. The thermal printer of claim 7, wherein a slot is disposed on the contacting component, the end of the resilient component is fixed to the casing, and the other end of the resilient component is installed inside the slot.

9. The thermal printer of claim 7, wherein the resilient component is a spring.

10. The thermal printer of claim 1, wherein the pivoting component is a shaft, and the holding portion comprises a groove slot for engaging with the shaft.

11. The thermal printer of claim 1, wherein the holding portion holds the pivoting component of the thermal head module and the guiding component pivots in a second rotating direction opposite to the first rotating direction relative to the casing, so that the thermal head module is installed inside the casing and the pivoting component is engaged with the engaging slot, and then the holding portion of the guiding component is separated from the pivoting component.

* * * * *